US005118539A

United States Patent [19]

Sebby et al.

[11] Patent Number: 5,118,539

[45] Date of Patent: Jun. 2, 1992

[54] FIREPLACE LOGS

[76] Inventors: David A. Sebby; Eunice J. Sebby, both of 7238 Bell Rd., Knoxville, Tenn. 37918

[21] Appl. No.: 644,440

[22] Filed: Jan. 22, 1991

[51] Int. Cl.[5] ..... A41G 1/00; C10L 5/36

[52] U.S. Cl. ..... 428/15; 44/535; 428/18; 431/125

[58] Field of Search ..... 428/15, 18; 431/125; 44/535

[56] References Cited

U.S. PATENT DOCUMENTS

| | | | |
|---|---|---|---|
| 3,042,109 | 7/1962 | Peterson | 431/125 X |
| 3,291,116 | 12/1966 | Brooks | 431/125 X |
| 3,377,229 | 4/1968 | Bryan | 428/18 |
| 3,817,686 | 6/1974 | Quittner | 431/125 |
| 3,993,430 | 11/1976 | Forker | 431/125 |
| 4,060,396 | 11/1977 | Burton | 428/65 X |
| 4,076,490 | 2/1978 | Hilker | 428/18 X |
| 4,883,043 | 11/1989 | Thow et al. | 428/18 X |
| 4,962,750 | 10/1990 | Bridgewater | 431/125 X |

*Primary Examiner*—Henry F. Epstein
*Attorney, Agent, or Firm*—Pitts and Brittian

[57] ABSTRACT

Fireplace logs (10-10A) for simulating a wood burning fire using a fuel log (18) which is economical, readily available, and safer than gas, and which requires minimal cleaning effort, while maintaining the desired qualities of a wood burning fire such as flame quality, sound, and smell. The fireplace logs (10-10A) include a first and second non-combustible ceramic log (12-14) in a spaced apart fashion such that a fuel log (18) may be centrally placed. Top logs (16-44-60) are placed above the fuel log (18) and engage at least a portion of the first and second logs (12 and 14). Openings (50-52-62) are defined between the logs (12-14-16-44-60) and cooperate with opening (53) to enhance the flow of air to the fuel log (18) and to cause the flame (26) derived from the burning fuel log (18) to lick the third log (16) to give an appearance of a wood burning fire. Opening (53) is also provided for the placement of the fuel log (18) with a substantially arcuate motion without necessitating the displacement of the artificial logs (10-10A). In an alternate embodiment, a fuel source tray (54) is provided to carry the fuel log (18). In the preferred embodiment, the fuel log (18) is impregnated with a variety of seeds (24) such as hemp, millet, and sunflower to simulate the popping sound of burning wood.

12 Claims, 3 Drawing Sheets

FIREPLACE LOGS

TECHNICAL FIELD

This invention relates to the field of noncombustible fireplace logs. More specifically it relates to a plurality of ceramic logs made to simulate natural wood logs and used in combination with existing fuel logs impregnated with a selection of seeds such as hemp, millet, and sunflower all of which are commonly found in bird seed to simulate a wood burning fire in appearance, smell and sound.

BACKGROUND ART

The use of fireplaces is widespread throughout this and other countries. The use of fireplaces inherently encompasses many hazards and nuisances, but as well has many benefits. These benefits include heat and entertainment. However, due to the expense of firewood, the inconveniences associated with chopping one's own firewood, retrieving the firewood from the outside when the fire begins to burn down, and continually cleaning ashes from the fireplace, several alternatives have been sought to replace the log-burning fires. In an attempt to replace these fires, obtaining all of the attributes of a wood fire has been difficult in that no substitute has been able to affect the proper color, size, and movement of a wood-fueled flame, along with the smell and sound of burning wood.

Gas has been commonly used to produce flames in a fireplace and has been used in combination with several different artificial logs to attempt creating the illusion of a real fire. See for example U.S. Pat. Nos. 3,291,116 issued to L.P. Brooks on Dec. 13, 1966; 3,042,109 issued to R.H. Peterson on Jul. 3, 1962; 3,817,686 issued to L.M. Quittner on Jun. 18, 1974; and 4,883,043 issued to I. Thow on Nov. 28, 1989. Several artificial logs have been designed to cooperate with such gas systems such as those discussed in U.S. Pat. Nos. 3,377,229 issued to L.E. Bryan on Feb. 12, 1965 and Des. 241,408 issued to J. G. Matchulat on Sep. 14, 1976. As taught by the Brooks Patent 3,291,116, and as is well known otherwise, the use of gas requires the adherence to strict regulations imposed by the American Gas Association. Not only are specific regulations imposed, but the use of gas is inherently dangerous in that faulty plumbing, whether by age, design, construction, or abuse, may create leakage of gas, thereby causing asphyxiation, an explosion, or both. The flame produced by burning gas is usually undesirable as well due to a limited flame height and the shape of the flame being a finger as opposed to a sheet. Gas also is insufficient to reproduce the sound and smell of a wood burning fire.

Other devices have been produced to simulate wood burning fires such as those disclosed in U.S. Pat. Nos. 3,993,430 issued to R. O. Forker on Nov. 23, 1976 and 4,076,490 devices teach a non-combustible log designed to carry a replaceable fuel source such as internally contained liquid fuel, canned heat products such as "Sterno", and candles. Such devices, though, provide for the specific location of a flame such that the effect of a real flame, that is a random size and location, is lost, as well as other characteristics previously discussed.

Yet another group of devices have been made to simulate a wood burning fire such as those disclosed in U.S. Pat. Nos. 4,060,396 issued to J. V. Burton on Nov. 29, 1977; 4,169,709 issued to J. F. Stima on Oct. 2, 1979; and 4,326,854 issued to J. D. Tanner on Apr. 27, 1982.

These devices are combustible simulated logs typically used in conjunction with wood fires as a starter. Such starter logs produce sufficient heat and flames to burn alone for several hours, yet, if burned alone, the atmosphere of a stack of logs is lost.

Therefore, it is an object of this invention to provide a means for simulating a traditional wood burning fire while maintaining the integrity of the characteristics associated therewith.

It is also an object of this invention to provide an artificial fireplace setting which may be used with a selected fuel source which provides a higher degree of safety than does gas.

Another object of this invention is to provide an artificial fireplace setting which may employ a fuel source readily available and economical.

Still another object of the present invention is to employ a fuel source which may be easily ignited, yet may be stored more safely than gas.

Yet another object of the present invention is to provide for a fuel source which requires only periodic cleaning of the fireplace.

DISCLOSURE OF THE INVENTION

Other objects and advantages will be accomplished by the present invention which serves to simulate a wood burning fire using a fuel source which is economical, readily available, and safer than gas, and which requires minimal cleaning effort, while maintaining the desired qualities of a wood burning fire such as flame quality, sound, and smell. The fireplace logs of the present invention include at least a spaced apart pair of non-combustible support logs between which a fuel source is placed and a non-combustible top log engaging at least a portion of the top portion of each support log such that the non-combustible top log is elevated above the fuel source. The non-combustible support logs and top log are dimensioned such that a space is created between each respective non-combustible log and the fuel source, thereby enhancing the flow of air to the fuel source and increasing the flame height. In the preferred embodiment, the fuel source is a fuel log which is readily available to consumers, safe to store, economical, and leaves only a small amount of debris to be cleaned. The non-combustible logs in the preferred embodiment are further dimensioned such that the arrangement of non-combustible logs and the fuel source may be supported by a typical fireplace grate. The preferred arrangement of the logs is such that openings are defined between the non-combustible top log and each of the non-combustible support logs respectively such that flames may lick the log arrangement to give the appearance of burning wood. To assist in this effect, at least the support logs are concave about the middle section to define a substantial hour-glass shape and each respective non-combustible log is colored to resemble a partially burned wood log.

While using a typical fuel log is sufficient to generate the desired effect for flame quality, it has been found that by impregnating such fuel log with a variety of seeds such as hemp, millet, and sunflower those commonly found in birdseed causes a popping sound much like that which a burning log makes as the moisture in the log is heated and ignites. This popping sound adds to the atmosphere created to make the use of the present invention less distinguishable from a wood burning fire.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Fireplace logs incorporating various features of the present invention are illustrated generally at 10 in the figures. The fireplace logs lo are designed for simulating a wood burning fire and are used in conjunction with a fuel source 17 which is economical, readily available, and safer than gas, and which requires minimal cleaning effort, while maintaining the desired qualities of a wood burning fire such as flame quality, sound, and smell.

Figure 1:
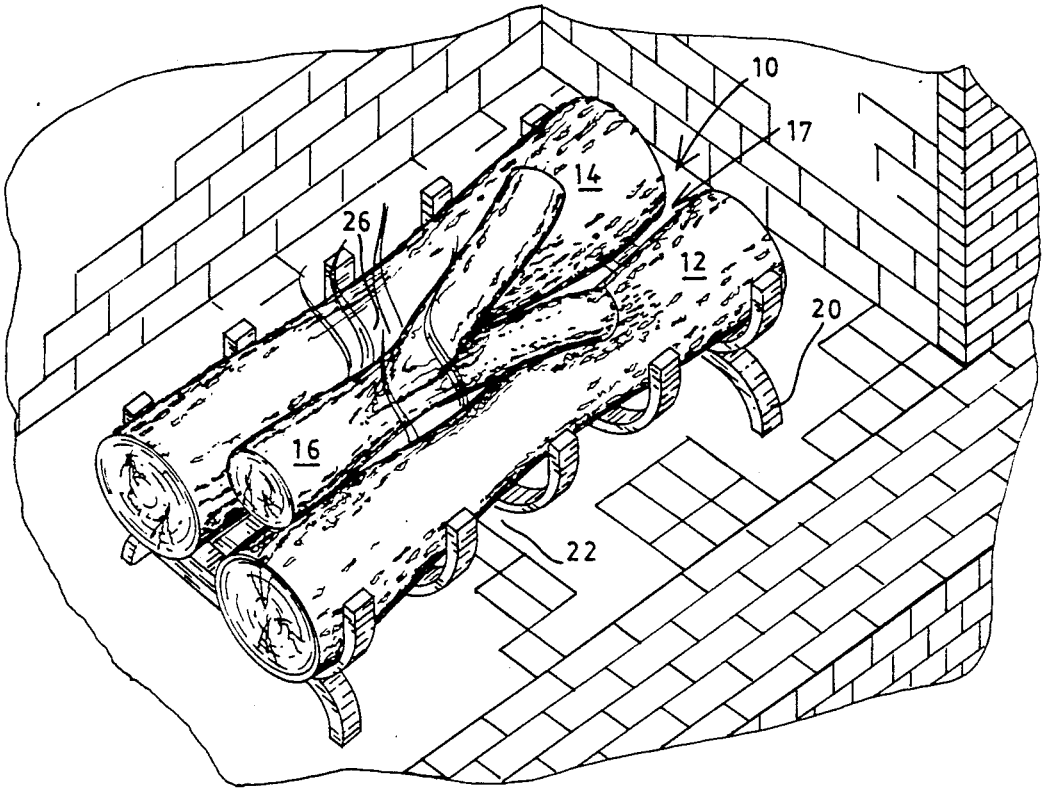
FIG. 1 is a perspective view of the fireplace logs constructed in accordance with several features of the present invention showing the fuel log burning, the arrangement being supported by a typical fireplace grate.

The fireplace logs 10 of the present invention include a first log 12 and a second log 14, the second log 14 being situated substantially parallel to and spaced a selected distance from the first log 12 to define a space 48 dimensioned to receive a fuel source 17. The first and second logs 12 and 14 each engage at least a portion of a support surface 22, or in the preferred embodiment a fireplace grate 20 which engages the support surface 22 as shown in FIG. 1. The logs 12 and 14 are each fabricated from a non-combustible material, preferably a ceramic. In the preferred embodiment, the log 14 defines a arger diameter than does the log 12. In this embodiment, the logs 12–14 are.concave about the circumference of each respective middle section 28 of the longitudinal axis such that a substantial hour-glass shape is defined, the concavities 28 being provided to enhance the appearance of a burning wood log. Each concavity 28 in the preferred embodiment is provided with appropriate coloring to further enhance the appearance of a burning wood log.

Figure 2:
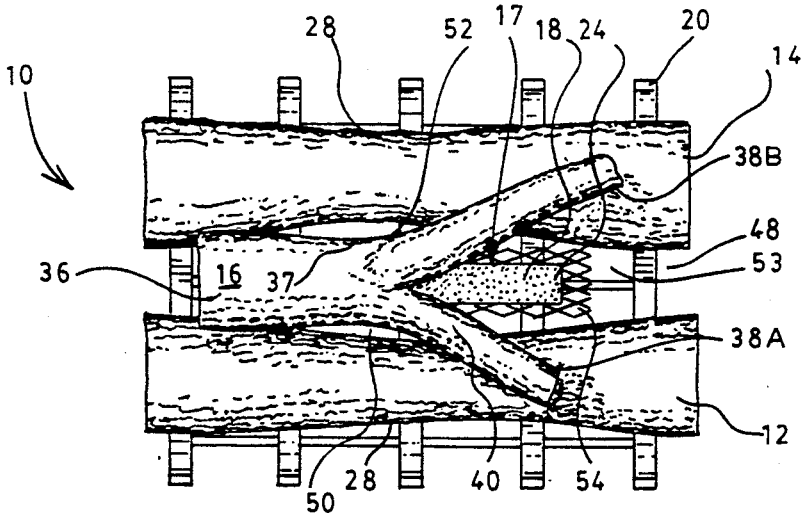
FIG. 2 illustrates a top elevation view of the fireplace logs of the present invention.
Figure 3:
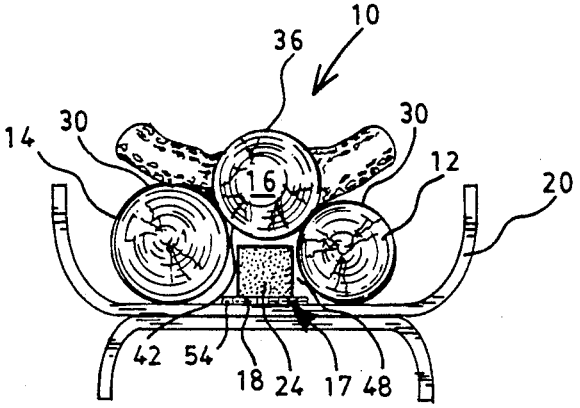
FIG. 3 is a left side elevation view thereof.
Figure 4:
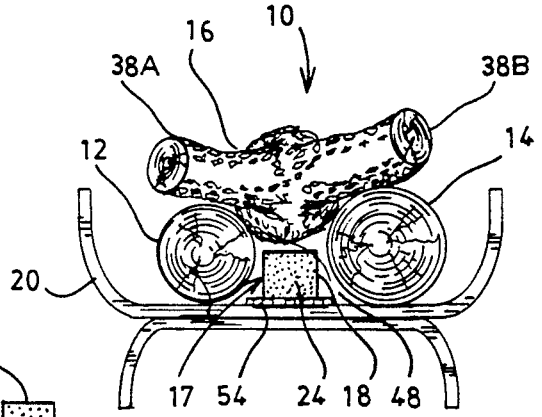
FIG. 4 is a right side elevation view thereof.
Figure 5:
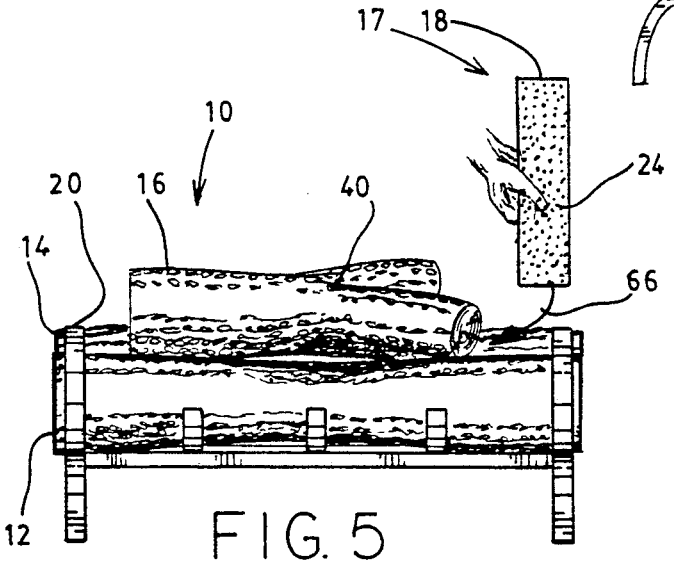
FIG. 5 is a front elevation view thereof showing a fuel log being inserted between the fireplace logs of the present invention.

A third log 16 is provided with a bottom portion 42 engaging at least a portion of the top portion 30 of the first and second logs 12 and 14, further defining space 48. Due to the diameter differential between the logs 12–14, when log 16 engages the logs 12–14, log 16 is tilted toward the outside of the fireplace. The third log 16 has a substantially "Y"-shaped configuration with a first end 36 and a second end 40, the second end 40 including a first leg 38A and a second leg 38B as shown in FIG. 2. The third log 16 is fabricated from a non-combustible material, preferably a ceramic. The third log 16 of the preferred embodiment is concave about the circumference of the middle section 37 of the longitudinal axis to enhance the appearance of burning wood. The concavity 37 of the preferred embodiment is provided with appropriate coloring to further enhance the appearance of a burning wood log. The first and second legs 38A–38B and the logs 12–14 define an opening 53 such that the fuel source 17 may be inserted into the space 48 with an arcuate motion as depicted by arrow 66 in FIG. 5.

In the preferred embodiment, concavities 28 and 37 of the first and third logs 12 and 16, respectively, define an opening 50, and concavities 28 and 37 of the second and third logs 14 and 16, respectively, define an opening 52. The openings 50, 52 and 53 are provided to enhance the flow of air to the fuel source 17 and to cause the flame 26 derived from the burning fuel source 17 to lick the third log 16 to give an appearance of a wood burning fire.

Figure 7:
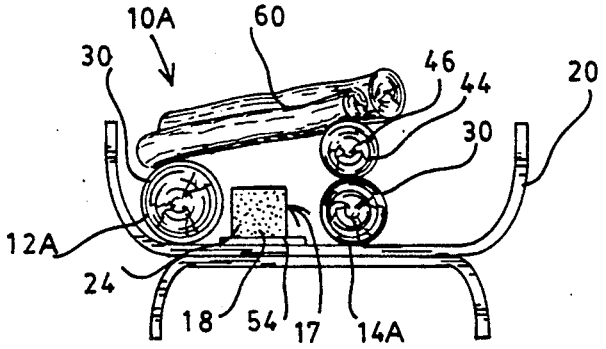
FIG. 7 is a right side elevation view of the alternate embodiment illustrated in FIG. 6.
Figure 6:
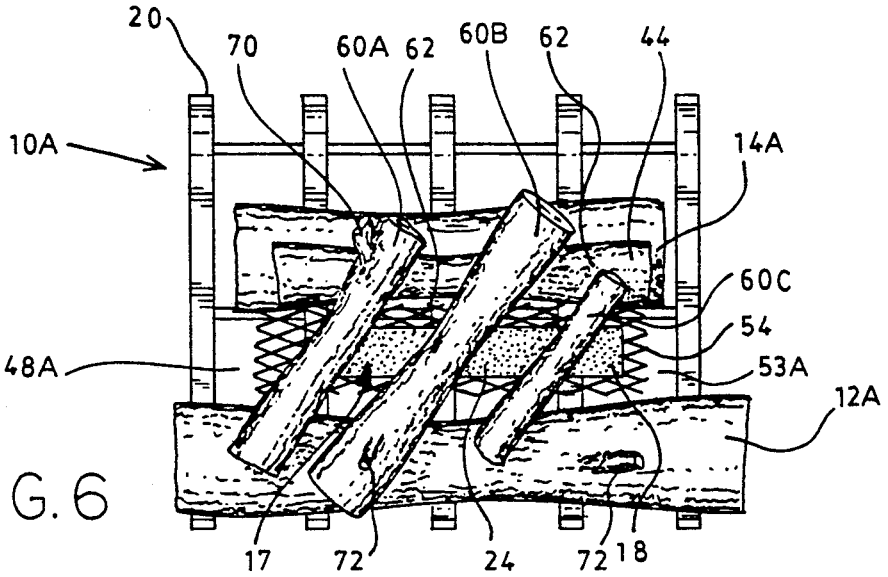
FIG. 6 illustrates a top elevation view of an alternate embodiment of the fireplace logs of the present invention.
Figure 8:
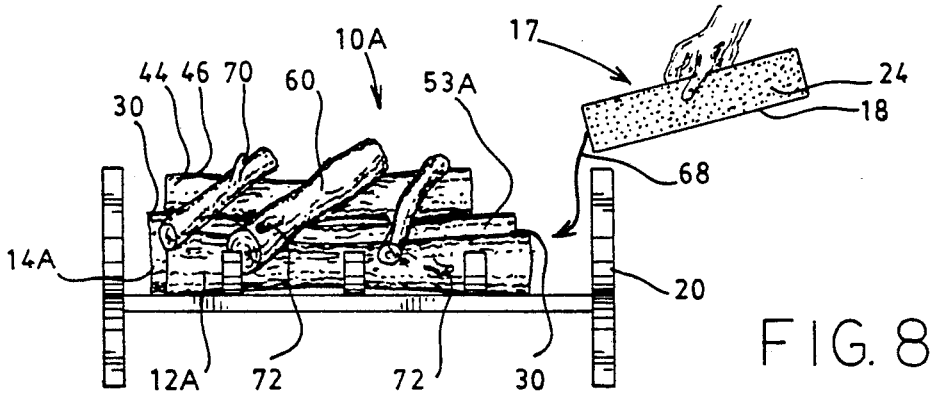
FIG. 8 is a front elevation view of the alternate embodiment illustrated in FIG. 6 showing a fuel log, in phantom, being inserted between the fireplace logs of the present invention.

An alternate embodiment of the fireplace logs is illustrated generally at **10*a* in FIGS. 6, 7 and 8. In this embodiment, logs 12A–14A correspond to logs 12–14 of the fireplace logs 10. A third log 44 has a substantial hour-glass configuration and engages the top surface 30 of the second log 14. The third log 44 in this embodiment is substantially parallel to the second log 14. A plurality of top logs 60 are provided to engage at least a portion of the top surface 30–46 of the first and third logs 12–44, respectively. Spaces 62 are defined between the top logs 60 for the passage of air, flames, and smoke. Each top log 60 has a substantial hour-glass configuration and is enhanced to appear as a partially burned wood log. Top log 60A illustrates a configuration including the stump 70 of a cut limb protruding from the log 60A. Logs 12–60B are shown to include open knot holes 72 for the passage of air, flames and smoke. It will be noted that these and other features may be included in any of the fireplace logs 10–10A for a more realistic appearance. A space 48A is defined between the first log 12A and the second and third logs 14A–44 and below the top logs 60 for receiving a fuel source 17. An opening 53A is defined by the first log 12A, the second and third logs 14A–44 and the top log 60C through which the fuel source 17 may be easily placed with an arcuate motion as illustrated by arrow 68 in FIG. 8**.

Figure 9:
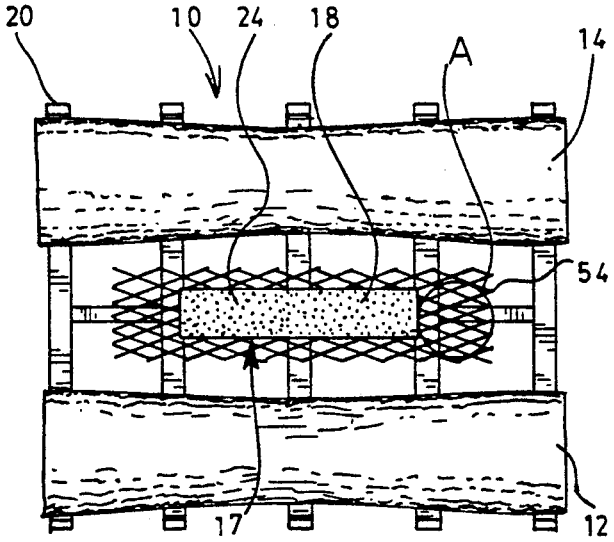
FIG. 9 is a top elevation view of the preferred embodiment with the third non-combustible log removed showing a fuel log receptacle.
Figure 10:
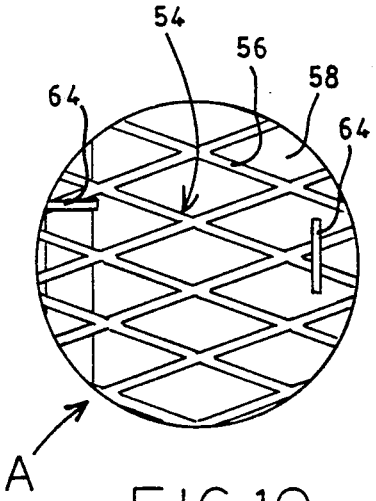

FIG. 9 illustrates a fuel source support means 54, also referred to as a fuel source tray 54, dimensioned to be carry the fuel source 17. The fuel source tray 54 of the preferred embodiment is fabricated from a rigid or semi-rigid, non-combustible material such as metal grate 56. The openings 58 defined by the metal grate 56 are dimensioned such that burned coals may pass through while larger pieces of the fuel source 17 are supported while burning, thus increasing the flame duration. In the preferred embodiment, the fuel source tray 54 is secured to the fireplace grate 20 such that as the fuel source 17 is being inserted through the opening 53A, the fuel source tray 54 will not move with respect to the fireplace grate 20. As shown in the enlarged portion of FIG. 9, the fuel source tray 54 is fastened with available wire fasteners 64. The fuel source tray 54 may alternatively be fastened with welds or any other common method.

In the preferred embodiment the fuel source 17 is a fuel log 18 fabricated generally from compressed wood particles. The preferred fuel log 18 may be broken into smaller pieces and selectively added to the fire to enhance the flame quality. Particles with a substantial cone-shaped configuration are preferred. However, readily available particle shapes such as wafers are sufficient. Although the use of a typical fuel log 18 is sufficient to generate the desired effect for flame quality, it has been found that by impregnating such fuel log with a variety of seeds 24 such as hemp, millet, and sunflower those commonly found in birdseed a popping sound is generated much like that which a burning log makes as the moisture in the log is heated and ignites. This popping sound adds to the atmosphere created to make the use of the present invention less distinguishable from a wood burning fire.

It will be noted that the logs 10–10A are designed such that the arrangement of the logs 10–10A may be altered to the tastes of the user and may be used in conjunction with other such logs 10–10A to increase the overall size of the arrangement.

From the foregoing description, it will be recognized by those skilled in the art that fireplace logs offering advantages over the prior art have been provided. Specifically, the fireplace logs include an arrangement of non-combustible logs to be used in conjunction with a fuel source such as a fuel log to simulate a wood burning fire. The fireplace logs of the present invention employ a fuel source which is safer than gas, requires minimal cleaning, and produces flames which embody the characteristics of flames attributable to a typical wood burning fire.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. Artificial fireplace logs for simulating a wood burning fire, said artificial fireplace logs comprising:

a pair of spaced apart logs for engaging a support surface, said pair of spaced apart logs being fabricated from a non-combustible material;

at least one cover log for engaging at least the top portion of said spaced apart logs, said cover log being fabricated from a non-combustible material;

a fuel source including a fuel log which is fabricated from a combustible material, said fuel source being dimensioned to be received between said spaced apart logs and beneath said cover log; and a ventilation means defined by said pair of spaced apart logs and said cover log for supplying air to said fire to sustain a flame and for passage of said flame.

2. The fireplace logs of claim 1 wherein said non-combustible material is ceramic.

3. The fireplace logs of claim 1 wherein said fuel source is a combustible fuel log composed of at least compressed wood particles for maintaining a fire.

4. The fuel log of claim 3 which is impregnated with seeds selected from a group consisting of hemp, millet, and sunflower.

5. Artificial fireplace logs for simulating a wood burning fire, said artificial fireplace logs comprising:

at least a pair of spaced apart artificial logs for engaging a support surface, said spaced apart artificial logs being fabricated from a non-combustible ceramic;

at least one artificial cover log for engaging at least the top portion of said spaced apart artificial logs, said artificial cover logs being fabricated from a non-combustible ceramic;

a fuel source including a fuel log which is fabricated from a combustible material, said fuel source being dimensioned to be received between said spaced apart logs and beneath said cover log; and a ventilation means defined by said pair of spaced apart artificial logs and said artificial cover logs and beneath said cover log; and a ventilation means defined by said pair of spaced apart artificial logs and said artificial cover logs for supplying air to said fire to sustain a flame and for passage of said flame.

6. The artificial fireplace logs of claim 5 which further comprises a fuel source support means for supporting said fuel source.

7. The artificial fireplace logs of claim 6 wherein said fuel source support means is fabricated from a rigid or semi-rigid non-combustible material.

8. The fuel source support means of claim 7 said rigid or semi-rigid non-combustible material is metal.

9. The artificial fireplace logs of claim 5 wherein said combustible fuel log is impregnated with seeds selected from a group consisting of hemp, millet and sunflower.

10. The fireplace logs of claim 5 which further comprise a fuel source placement means for the placement of said fuel source onto said fuel source support means.

11. The fireplace logs of claim 10 wherein said fuel source placement means is an opening defined by said pair of spaced apart artificial logs and said artificial cover logs, said opening being dimensioned such that said fuel source may be placed upon said fuel source support means with a substantially arcuate motion without necessitating the displacement of said artificial logs.

12. Artificial fireplace logs for simulating a wood burning fire, said artificial fireplace logs comprising:

a fuel source including a fuel log composed of at least compressed wood particles, said fuel log being impregnated with seeds selected from a group consisting of hemp, millet, and sunflower;

at least a pair of spaced apart artificial logs for engaging a support surface and between which may be placed said fuel source, said spaced apart artificial logs being fabricated from a non-combustible ceramic;

at least one artificial cover log for engaging at least the top portion of said spaced apart artificial logs and covering at least a portion of said fuel source, said artificial cover logs being fabricated from a non-combustible ceramic;

a ventilation means defined by said pair of spaced apart artificial logs and said artificial cover logs for supplying air to said fire to sustain a flame and for passage of said flame;

a fuel source support means for supporting said fuel source, said fuel source support means being fabricated from metal; and a fuel source placement means for the placement of said fuel source onto said fuel source support means, said fuel source place means being an opening defined by said pair of spaced apart artificial logs and said artificial cover logs, said opening being dimensioned such that said fuel source may be placed upon said fuel source support means with a substantially arcuate motion without necessitating the displacement of said artificial logs.

* * * * *